US008527087B1

(12) United States Patent
Humble

(10) Patent No.: US 8,527,087 B1
(45) Date of Patent: Sep. 3, 2013

(54) DUNNAGE PLACER

(76) Inventor: Erik L. Humble, Otis Orchards, WA (US)

( * ) Notice: Subject to any disclaimer, the term of this patent is extended or adjusted under 35 U.S.C. 154(b) by 0 days.

(21) Appl. No.: 13/506,990

(22) Filed: May 30, 2012

(51) Int. Cl.
*G06F 7/00* (2006.01)

(52) U.S. Cl.
USPC ..... 700/228

(58) Field of Classification Search
USPC ..... 700/228
See application file for complete search history.

(56) References Cited

U.S. PATENT DOCUMENTS 4,815,190 A * 3/1989 Haba et al. ..... 29/430
4,894,908 A * 1/1990 Haba et al. ..... 29/711
8,229,586 B2 * 7/2012 Wallace et al. ..... 700/112

* cited by examiner

*Primary Examiner* — Ramya Burgess
(74) *Attorney, Agent, or Firm* — Thomas Olson

(57) ABSTRACT

A dunnage placing apparatus includes a chassis, a dunnage magazine, and a carriage movably supported by the chassis and adapted to receive dunnage pieces from the magazine. The carriage has a lower gate, an intermediate gate substantially above the lower gate, and an upper gate substantially above the intermediate gate. The apparatus includes a control system adapted to cause dunnage pieces to be released from the magazine and received into the carriage. The control system also causes the carriage to move relative to the chassis and to release dunnage pieces. The released dunnage pieces released from the carriage can be placed at respective predetermined locations.

8 Claims, 6 Drawing Sheets

DUNNAGE PLACER

TECHNICAL FIELD

The disclosures provided herein relate to dunnage placing, and more specifically, to placing dunnage onto stacks of material.

BACKGROUND

Dunnage is widely used in many industries and in many applications. In many instances, dunnage is used to provide gaps or spaces in groups of stacked items. More specifically, dunnage is often used to provide a space or gap in order to allow the tines of a forklift or other material handing device to move a group of items that make up a stack. For example, consider a stacked group of items that is to be carried by a forklift and then set on a floor. It is often desirable to position several pieces of dunnage on the floor, and then to set the items on the dunnage. In this way, the dunnage provides a space or gap between the floor and the items so that the tines of the forklift can be easily removed from beneath the items after they are set in place on the dunnage. Similarly, the gap or space between the floor and the items allows the items to be more easily picked up with the forklift.

Dunnage is often employed in this manner in the lumber industry. For example, in many modern sawmills, and other types of lumber production and/or processing facilities, high-speed automatic lumber stackers or stack formers are used. These automatic stackers collect lumber pieces or boards from a production line and position or arrange the collected pieces into organized stack units. Often, the stacker is setup to form stack units of a given size and/or weight. The given stack unit size or weight can be determined according to one or more various factors. These factors can include, for example, the handling capacity of equipment that may be used to move or transport the stack units, and/or the handling capacity of equipment that may be used for additional processing of the stack units. For example, a common practice in the lumber industry is to employ a forklift to pick up the stack units as they emerge from the automatic stacker. Thus, the stack units must be of a size and/or weight that does not exceed the capacity of the forklift.

Typically, as stack units emerge from an automatic stacker, they are picked up by a forklift and then arranged one-on-top-of-another to facilitate efficient use of storage space or processing space. Dunnage pieces are often placed onto stack units as they emerge from the automatic stacker. More specifically, dunnage pieces are placed onto the stack units upon which other stack units will be placed. In many instances, a stockpile of dunnage is maintained near the output location of the automatic stacker. At the time a given stack unit is picked up by a forklift from the automatic stacker, the forklift driver will know whether dunnage is required to be placed on the given stack unit. If dunnage is required, it can be manually picked from the dunnage stockpile, and then placed onto the top of the stack unit that is to be picked up. Often, this manual picking and placement of the dunnage is done by the forklift driver. After the dunnage is placed on top of the stack unit, the forklift carries the stack unit to its destination with the dunnage in place on the top of the stack unit.

The identification of problems, deficiencies, potential or actual benefits or advantages described above is not admitted to be prior art.

DESCRIPTION OF THE DRAWINGS

Preferred forms, configurations, embodiments and/or diagrams relating to and helping to describe preferred aspects and versions of the inventions provided for herein are explained and characterized herein, often with reference to the accompanying drawings. The drawings, and all features shown therein, also serve as part of the disclosure of the inventions encompassed within the current document, whether described in text or merely by graphical disclosure alone. Such drawings are briefly described below.

FIG. 8 is the second of the series of views of which FIG. 7 is the first.

FIG. 9 is the third of the series of views of which FIG. 7 is the first.

FIG. 10 is the fourth of the series of views of which FIG. 7 is the first.

DETAILED DESCRIPTION

The readers of this document should understand that the embodiments described herein may rely on terminology used in any section of this document and other terms readily apparent from the drawings and the language common therefor as may be known in a particular art, and such as known or indicated and provided by dictionaries. Dictionaries were used in the preparation of this document. Widely known and used in the preparation hereof are Webster's Third New International Dictionary (© 1993), The Oxford English Dictionary (Second Edition, © 1989), The New Century Dictionary (© 2001-2005), and the online dictionary, www.merriam-webster.com., all of which are hereby referenced for interpretation of terms used herein and for application and use of words defined in such references to more adequately or aptly describe various features, aspects and concepts shown or otherwise described herein using more appropriate words having meanings applicable to such features, aspects and concepts which are depicted or otherwise disclosed herein.

This document is premised upon using one or more terms with one embodiment that may also apply to other embodiments for similar structures, functions, features and aspects of the inventions. Wording used in the claims is also descriptive of the inventions, and the text and meaning of the claims and abstract are hereby incorporated by reference into the description in their entirety as originally filed. Terminology used with one, some or all embodiments may be used for describing and defining the technology and exclusive rights associated herewith.

The readers of this document should further understand that the embodiments described herein may rely on terminology and features used in any suitable section or other embodiments shown in this document and other terms readily apparent from the drawings and language common or proper therefor. This document is premised upon using one or more terms or features shown in one embodiment that may also apply to or be combined with other embodiments for similar structures, functions, features and aspects of the inventions and provide additional embodiments of the inventions.

The invention(s) provided for by this disclosure may include a number of different specific configurations, embodiments, and/or variations, some or all having different advantages or effects relative to features, operation and production.

Features shown on some of the illustrated and/or described versions may also be used on other embodiments if aspects of construction and use do not prevent such added configurations from being implemented according to this disclosure.

Figure 1:
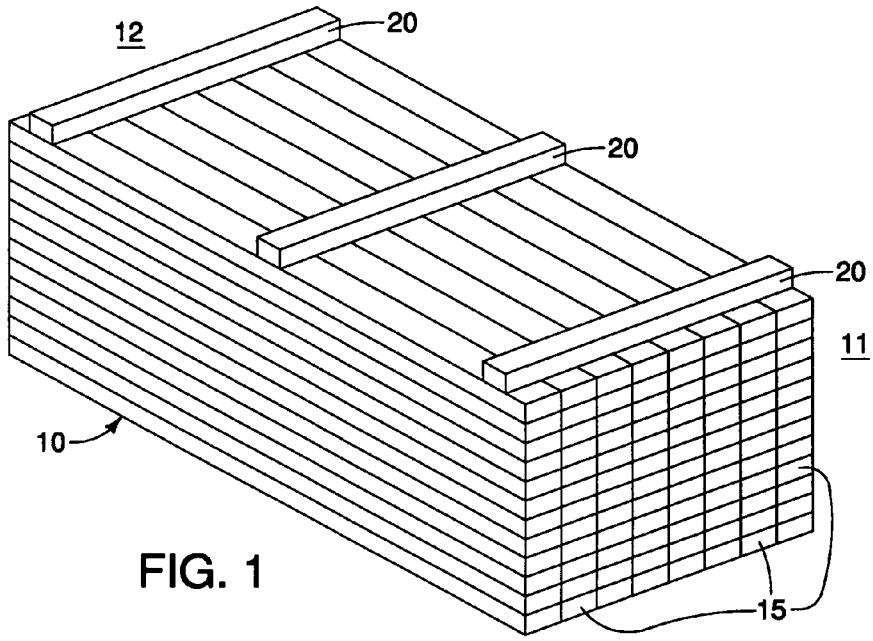
FIG. 1 is an isometric view in which a stack unit is depicted.

With reference now to the attached drawings, FIG. 1 is an isometric view in which a stack unit 10 is depicted according to at least one embodiment of the present disclosure. The stack unit 10 has a first end 11 and an opposite second end 12. The stack unit 10 is made up of individual stacked items 15. The stacked items 15 can have at least one of a number of possible forms. By way of example, the stacked items 15 can be in the form of elongated elements such as beams, boards, posts or the like. The stacked items 15 can be one or more of a number of materials such as, but not limited to, wood, metal, polymer and composite material. According to one or more embodiments of the present disclosure, the stacked items 15 are newly manufactured bulk products such as lumber, for example, and the stack unit 10 is a product packaging unit and/or a product processing unit. As is seen from a study of FIG. 1, the exemplary stacked items 15 are arranged in a plurality of rows and columns to form an array. It is to be understood that the stack unit 10 can be alternatively formed from a single column of sheets or panels according to at least one alternative embodiment of the present disclosure. By way of example only, such sheets or panels can be in the form of wood products such as, but not limited to, plywood, fiberboard, strandboard, waferboard, and sheetrock.

With continued reference to FIG. 1, a plurality of dunnage pieces 20 are supported on top of the stack unit 10. The dunnage pieces 20 can be supported on the top of the stack unit 10 in a substantially transverse orientation relative to the individual stacked items 11, as shown. The exemplary dunnage pieces 20 are placed on the stack unit 10 so as to have a longitudinal orientation that is substantially perpendicular to the longitudinal orientation of the stacked items 11. As is depicted, a dunnage piece 20 is positioned proximate the first end 11 of the stack unit 10, while another piece is positioned proximate the second end 12 of the stack unit, and yet another dunnage piece is positioned intermediate the first and second ends of the stack unit.

The dunnage pieces 20 can be formed from a number of suitable materials. For example, the dunnage pieces 20 can be substantially in the form of sawn lumber. According to one or more embodiments of the present disclosure, each of the dunnage pieces 20 has a substantially square cross sectional shape, as depicted. For example, each of the dunnage pieces 20 can be a standard rough-cut four-by-four (4×4) wood board or timber. It is to be understood that the dunnage pieces 20 can contain and/or can be made from materials other than wood. The dunnage pieces 20 are of a suitable length and generally extend across the entire width of the stack unit 10, as depicted. The dunnage pieces 20 are placed onto the stack unit by apparatus and methods described hereinbelow according to one or more embodiments of the present disclosure.

Figure 2:
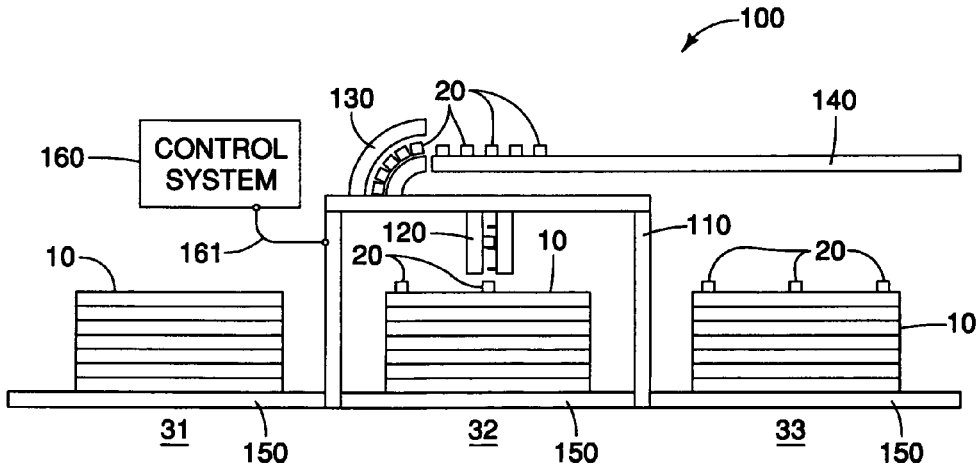
FIG. 2 is simplified side elevation view in which an apparatus is depicted according to at least one embodiment of the present disclosure.

Turning now to FIG. 2, a side elevation view depicts an apparatus 100 according to at least one embodiment of the present disclosure. For purposes of clarity, the apparatus of FIG. 2 is depicted in extremely simplified form, and certain features, components and/or portions of components not essential to the understanding of the description provided herein have been omitted. The apparatus 100 is adapted to place dunnage pieces 20 onto stack units 10. The dunnage pieces 20 used in conjunction with operation of the exemplary apparatus 100 are all substantially identical to each other in size and shape. The apparatus 100 can be adapted to operate using dunnage pieces 20 of a particular size and/or shape. According to at least one embodiment of the present disclosure, the apparatus 100 is adapted to be adjustable so as to be set up to operate using dunnage pieces 20 of a given size and/or shape. According to at least one embodiment of the present disclosure, the dunnage pieces 20 are reused until they become worn beyond acceptable limits from normal use.

The apparatus 100 includes a support frame or chassis 110. The chassis 110 is adapted to act as a substantially rigid structural support for other components of the apparatus 100. The chassis 110 can be constructed, for example, from structural steel members such as, for example, beams, channels, tubes, and the like. The apparatus 100 includes a carriage 120. The carriage 120 is movably supported on the chassis 110. More specifically, the carriage 120 is adapted for movement relative to the chassis 110 by way of one or more guides and/or tracks and the like (not shown) that are configured to facilitate movement of the carriage relative to the chassis. The carriage 120 and/or the chassis 110 can be adapted to enable movement of at least a portion of the carriage in a plurality of dimensions relative to the chassis. According to the exemplary embodiment of the present disclosure, at least a portion of the carriage 120 is adapted to move only substantially horizontally relative to the chassis 110, while another portion of the chassis is adapted to move both substantially horizontally and substantially vertically relative to the chassis.

The carriage 120 is adapted to carry a plurality of dunnage pieces 20, and to place the dunnage pieces on the a stack unit 10. The apparatus 100 includes a dunnage magazine 130. The dunnage magazine 130 can be supported by the chassis 110. Alternatively, the magazine 130 can be supported by a dedicated and/or separate support structure (not shown). The dunnage magazine 130 is adapted to accumulate and/or to contain therein a plurality of dunnage pieces 20 that are destined to be transferred to, or loaded onto, the carriage 120. The dunnage magazine 130 is configured in a manner wherein the dunnage pieces 20 contained within the magazine can be selectively released therefrom, and to thereby drop or fall therefrom under the force of gravity into the carriage 120 when the carriage is to be loaded.

The apparatus 100 can include a magazine feed conveyor 140. The feed conveyor 140 is adapted to supply and/or convey dunnage pieces 20 to the dunnage magazine 130. According to one or more embodiments of the present disclosure, the feed conveyor 140 is adapted to selectively feed and/or load dunnage pieces 20 directly into the dunnage magazine 130. The magazine feed conveyor 140 can be at least partially supported by the chassis 110. Alternatively, the magazine feed conveyor 140 can be supported by a dedicated and/or separate support structure (not shown). The feed conveyor 140 can include, or can receive the dunnage pieces 20 from, an unscrambler and other related devices (not shown), which are adapted to unscramble and/or substantially align and/or straighten and/or space the dunnage pieces 20 on the feed conveyor as depicted. The unscrambler and other related devices are known to those of skill in the art.

The apparatus 100 can include a stack unit conveyor 150. The stack unit conveyor 150 is adapted to convey thereon one or more stack units 10. More specifically, the stack unit conveyor 150 is adapted to convey or move a stack unit 10 from an initial position 31 to a receiving position 32. The initial position 31 is a position at which the stack unit is placed onto the stack unit conveyor 150. Such placement of the stack unit 10 onto the stack unit conveyor 150 at the initial position 31 can be accomplished by one of a number of means such as, but not limited to, automatic outfeed mechanisms (not shown) associated with an automatic stacker (not shown) that forms the stack units. Alternatively, for example, the stack units 10 can be placed onto the stack unit conveyor 150 at the initial position 31 by a forklift (not shown).

The receiving position 32 is a position or range of positions of the stack unit 10 at which the carriage 120 places dunnage pieces 20 onto the stack unit. According to at least one embodiment of the present disclosure, the stack unit conveyor 150 is adapted to convey the stack units 10 beneath the carriage 120 and the chassis 110, as depicted in FIG. 2. According to the exemplary embodiment of the present disclosure, the stack unit is located substantially beneath the chassis 110 when in the receiving position 32, as depicted. As is described in greater detail herein with reference to additional drawing figures, several dunnage pieces 20 are selectively released from the carriage 120 and placed onto a stack unit 10 that is parked or temporarily stopped at the receiving position 32, according to one or more embodiments of the present disclosure. It is to be understood, however, that according to alternative embodiments of the present disclosure, the apparatus 100, including the carriage 120, is adapted to place dunnage pieces 20 onto a moving stack unit 10, which does not stop or park as it travels beneath the chassis 110.

The stack unit conveyor 150 is adapted to convey or move a stack unit 10 from the receiving position 32 to a removal position 33. The removal position 33 is a position at which the stack unit 10 is removed from the stack unit conveyor 150. The stack unit 10 can be removed from the stack unit conveyor 150 by one of a number of possible removal means. By way of example only, the stack unit 10 can be removed from the stack unit conveyor 150 at the removal position 33 by a forklift or the like (not shown). According to the exemplary embodiment of the present disclosure, dunnage pieces 20 have been placed by the carriage 120 onto at least a portion of the stack units 10, which are then removed from the stack unit conveyor 150 at the removal position 33 with the dunnage pieces in place on top of the stack units.

The apparatus 100 can include a control system 160, which is described in greater detail hereinbelow with respect to additional drawing figures. With continued reference to FIG. 2, the control system 160 includes one or more suitable data links or communication links 169. The data link 169 is adapted to carry and/or distribute and/or transmit data signals and/or control signals and/or input signals and/or output signals that are generated and/or transmitted and/or received by one or more components of the control system 160. The control system 160 is adapted to control operation of the apparatus 100 according to an associated control scheme, whereby the apparatus operates to place dunnage pieces 20 onto a stack unit 10. According to the exemplary embodiment of the present disclosure, the control system 160 includes a plurality of input devices and output devices (not shown). Input devices can include, for example, one or more types of sensors adapted to generate input signals indicative of one or more detected operational parameters of the apparatus 100. Output devices can include, for example, one or more types of motors and/or actuators adapted to cause movement of various associated portions of the apparatus in response to operational control signals or output signals generated by the control system 160

According to one embodiment of the present disclosure, and by way of example only, a description of various operation and/or control functions of the control system 160 and other portions of the exemplary apparatus 100 is provided hereinbelow with reference to FIG. 2. Initially, for example, the control system 160 generates a querry to determine whether the dunnage magazine 130 needs to be loaded with dunnage pieces 20. This determination can be facilitated, for example, by one or more sensors (not shown) adapted to detect whether a predetermined quantity of dunnage pieces 20 are contained within the magazine 130. The control system 160 causes the magazine feed conveyor 140 to bring dunnage pieces 20 into the dunnage magazine 130 in response to determining that the dunnage magazine needs to be loaded with dunnage pieces. The control system 160 causes the feed conveyor 140 to stop bringing dunnage pieces 20 to the magazine 130 in response to determining that the magazine contains a predetermined quantity of dunnage pieces.

The control system 160 generates a querry to determine whether the carriage 120 needs to be loaded with dunnage pieces 20. This determination can be facilitated, for example, by one or more sensors (not shown) that are adapted to detect presence of a predetermined quantity of dunnage pieces 20 contained by the carriage 120. In response to determining that the carriage 120 needs to be loaded, a querry is made to determine whether the carriage 120 is in the loading position. The carriage loading position is a position of the carriage 120 relative to the magazine 130, at which the carriage is able to receive dunnage pieces 20 that are released from the magazine. A process of determining and/or tracking the position of the carriage 120 relative to the magazine 130 can be facilitated by one or more of a number of means including, but not limited to, employing an encoded stepper motor (not shown) as a prime mover for the carriage relative to the magazine, and/or employing one or more sensors (not shown) adapted to detect the presence of the carriage at respective predetermined locations.

The control system 160 causes the carriage 120 to move to the loading position in response to determining that the carriage 120 needs to be loaded with dunnage pieces 20, and that the carriage is not at the loading position. In response to determining that the carriage 120 is at the loading position, the control system 160 causes the magazine 130 to release therefrom a predetermined number of dunnage pieces 20. The control system 160 causes the carriage 120 to receive the dunnage pieces 20 from the magazine 130, and to stow the received dunnage pieces in preparation for placement of the dunnage pieces onto a stack unit 10. The process of releasing the dunnage pieces 20 from the magazine 130 and receiving the dunnage pieces into the carriage 120, and stowing the dunnage pieces, is described in greater detail hereinbelow with respect to additional drawing figures.

Still referring to FIG. 2, the control system 160 generates a querry to determine whether a stack unit 10 is approaching the dunnage placing position 32 from the initial position 31. A process of determining and/or tracking respective positions of stack units 10 on the stack conveyor 150 can be facilitated by one or more of a number of manners including, but not limited to, employing one or more sensors (not shown) adapted to detect or track relative positions of the stack units. In response to determining that a stack unit 10 is approaching the dunnage placing position 32, a query is generated to determine whether dunnage 20 is to be placed on the approaching stack unit. Such a determination can be made according to one of a number of criteria. For example, the control system 160 can receive inputs or instructions from a human operator regarding which particular stack units 10 are to have dunnage pieces 20 placed upon them. Alternatively, for example, the control system 160 can make such a determination according to a predetermined scheme or algorithm (not shown). By way of example only, such an algorithm can specify that dunnage pieces 20 are to be placed only on every other stack unit 10 that passes through the receiving position 32.

With continued reference to FIG. 2, the control system 160 generates a querry to determine whether a given stack unit 10 that is supported on the stack conveyor 150 is approaching the receiving position 32. The determination of whether a stack unit 10 is approaching the dunnage placing position 32 can be facilitated by one or more sensors (not shown) adapted to detect whether a stack unit 10 is at a predetermined position on the stack conveyor 150. In response to determining that the approaching stack unit 10 is not to have dunnage pieces 20 placed thereon, the control system 160 commands the stack conveyor 150 to move the approaching stack unit through the receiving position 32, and on to the removal position 33 without receiving dunnage pieces.

Alternatively, the control system 160 commands the stack unit conveyor 150 to park the approaching stack unit 10 at the dunnage receiving position 32 in response to determining that the approaching stack unit is to have dunnage pieces 20 placed upon it. The control system 160 then generates a querry to determine if the approaching stack unit 10 has arrived at the dunnage receiving position 32. This determination can be facilitated by use of one or more sensors (not shown) adapted to detect and/or track the position of one or more stack units 10 on the track conveyor 150. In response to determining that the stack unit 10 has arrived at the receiving position 32, the control system 160 causes the carriage 120 to place dunnage pieces 20 onto the stack unit. According to at least one embodiment of the present disclosure, the carriage 120 places dunnage pieces 20 onto the stack unit 10 at predetermined positions relative to the stack unit.

With continued reference to FIG. 2, the control system 160 generates a querry to determine whether the carriage 120 has completed placement of dunnage pieces 20 on the stack unit 10. In response to determining that the carriage 120 has completed placement of dunnage pieces 20 onto the stack unit 10, the control system 160 causes the carriage to return to the loading position. The control system 160 also causes the stack conveyor 150 to move the stack unit 10 out of the dunnage receiving position 32 and toward the removal position 33, in response to determining that the carriage 120 has finished placing dunnage pieces 20 onto the stack unit 10. When the stack unit 10 arrives at the removal position 33, the stack unit can be removed from the stack conveyor 150 by a forklift or the like.

The process of placing dunnage pieces 20 onto stack units 10 can be performed substantially continually. More specifically, a substantially continuous succession of stack units 10 can be placed, one-after-another, onto the stack conveyor 150 at the initial position 31. This substantially continuous succession of stack units 10 can be moved by the stack conveyor 150 from the initial position 31 to the dunnage receiving position 32, and then from the receiving position to the removal position 33. Dunnage pieces 20 can be placed onto at least a selected number of the substantially continuous succession of stack units 10 at the receiving position 32. The substantially continuous succession of stack units 10 can be removed, one-after-another, from the stack conveyor 150 at the removal position 33.

Figure 3:
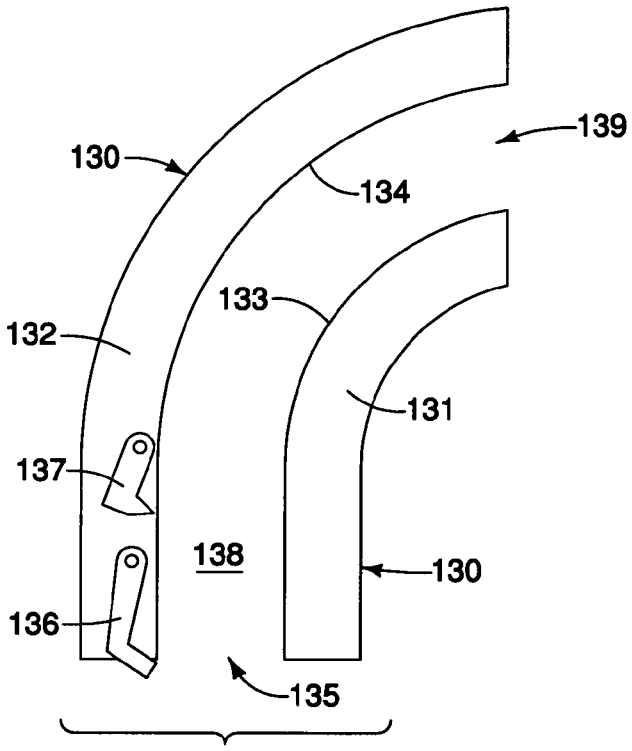
FIG. 3 is a simplified side elevation view in which a magazine of the apparatus of FIG. 2 is depicted in isolation.

Turning now to FIG. 3, a side elevation view depicts a dunnage magazine 130 in isolation according to one or more embodiments of the present disclosure. For illustrative purposes and for clarity, the depiction in FIG. 3 of the magazine 130 is simplified. Moreover, one or more components and/or portions of components of the magazine 130, which are not necessary for understanding the configuration and/or operational characteristics of the magazine, have been omitted. The magazine 130 includes at least two guides or guide sets. More specifically, the magazine 130 includes at least one first guide 131 and at least one second guide 132. Each first guide 131 defines thereon a first guide surface 133. Similarly, each second guide 132 defines thereon a second guide surface 134. According to the exemplary embodiment of the present disclosure, the magazine 130 includes a plurality of first guides 131 and a plurality of second guides 132. The first guides 131 of the exemplary magazine 130 are arranged in mutually juxtaposed alignment, wherein only one first guide is visible in the view depicted by FIG. 3. Similarly, the second guides 132 of the exemplary magazine 130 are in mutually juxtaposed alignment, wherein only one second guide is visible in the view depicted by FIG. 3.

Each of the guides 131, 132 can be formed form a suitably durable material such as, for example, steel plate. According to the exemplary embodiment of the present disclosure, at least one first guide 131 is associated with at least one second guide 132. More specifically, the associated first guide 131 and second guide 132 are positioned relative to each other, wherein the first guide surface 133 and the associated second guide surface 134 are opposed or spaced apart so as to define therebetween an elongated path 138. The path 138 is bounded on each side thereof by the first guide surface 133 and the second guide surface 134, respectively. The guides 131, 132 are tied together in substantially fixed relation to each other by being affixed to one or more braces, frameworks or other such structures, which are omitted for clarity.

With continued reference to FIG. 3, the magazine 130 defines a lower end 135 and an opposite upper end 139. According to the exemplary embodiment of the disclosure, the lower end 135 is substantially in the form of a lower opening of the path 138, while the upper end 139 is substantially in the form of an upper opening of the path. More specifically, the lower end 135 can be described as the magazine exit, while the upper end 139 can be described as the magazine entrance. A study of FIG. 3 reveals that at least a portion of each of the guide surfaces 133, 134 as well as the path 138 are substantially curved or arcuate. According to the exemplary embodiment of the present disclosure, the path 138, and the guide surfaces 133, 134, transition from a nearly horizontal orientation proximate the upper end 139 to a substantially vertical orientation proximate the lower end 135.

The magazine 130 can include one or more sensors (not shown). At least one of the sensors is adapted to detect the presence of one or more dunnage pieces (not shown) within the magazine 130. According to one or more embodiments of the present disclosure, at least one sensor is adapted to detect the presence of a dunnage piece (not shown) at a given location or position within the magazine 130. By way of example only, one or more sensors can be at least one of a proximity sensor, a photoelectric sensor, and a limit switch. The sensors can be supported by the magazine 130. By way of example only, the sensors can be supported on one or more of the guides 131, 132. It is to be understood however, that the sensors associated with the magazine 130 can be supported on components and/or structure other than the magazine itself, according to one or more alternative embodiments of the present disclosure.

Still referring to FIG. 3, the magazine 130 is configured so that dunnage pieces (not shown) are introduced or loaded into the magazine through the upper end 139, and are released from the magazine through the lower end 135. According to one or more embodiments of the present disclosure, the dunnage pieces are introduced into the upper end 139 from a substantially horizontal direction. For example, dunnage pieces can be introduced into the upper end 139 from a substantially horizontally oriented conveyor 140, as is seen from a study of FIG. 2. Returning to FIG. 3, dunnage pieces are released in a substantially vertical direction from the lower end 135 of the magazine 130. According to the exemplary embodiment of the present disclosure, dunnage pieces are released from the lower end 135 to thereby drop in a substantially vertically downward direction under the force of gravity.

With continued reference to FIG. 3, the magazine 130 includes at least one gate member. More specifically, the magazine 130 includes at least one first gate member 136. The exemplary magazine 130 also includes at least one second gate member 137. The gate members 136, 137 are operatively supported by the magazine 130. According to the exemplary embodiment of the present disclosure, at least one of the first gate members 136 and at least one of the second gate members 137 are be pivotally supported by one of the guides, such as the second guide 132, as shown. At least one of the first and second gate members 136, 137 is adapted to facilitate selective release of dunnage pieces (not shown) from the magazine 130. According to the exemplary embodiment of the present disclosure, the first and second gate members 136, 137 are adapted for mutually complementary operation in facilitating selective release of one or more dunnage pieces (not shown) from the lower end 135 of the magazine 130. It is to be noted that both the first gate member 136 and the second gate member 137 are depicted in FIG. 3 to be in respective open positions.

Figure 4:
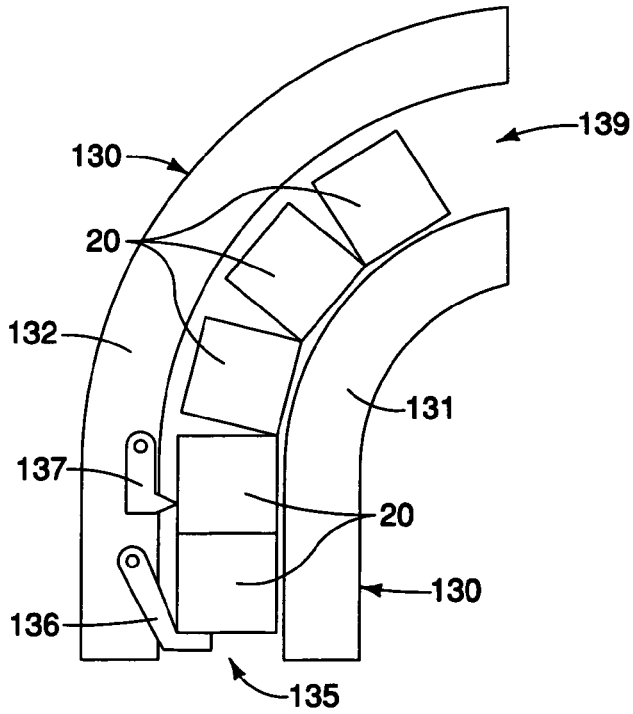
FIG. 4 is another simplified side elevation view of the magazine depicted in FIG. 3.

Turning now to FIG. 4, another side elevation view depicts the magazine 130, which is depicted in FIG. 3. The respective views of the magazine 130 in FIGS. 3 and 4 are substantially the same, except that FIG. 4 depicts the first and second gate members 136, 137 in respective closed positions, while FIG. 3 depicts the first and second gate members in respective opened positions. Movement of the gate members 136, 137 between the respective opened and closed positions can be facilitated, for example, by use of respective actuators (not shown) operatively connected between the second guide 132 and the associated gate member, for example. An additional difference between FIGS. 3 and 4 is that FIG. 4 depicts the magazine 130 in a loaded state, compared with FIG. 3 which depicts the magazine in an empty state. More specifically, FIG. 4 depicts a plurality of dunnage pieces 20 contained within the magazine 130, while FIG. 3 depicts no dunnage pieces.

With continued study of FIG. 4, the first gate member 136 can be a blocker gate, while the second gate member 137 can be a gripper gate. The blocker gate, which is exemplified by the first gate member 136, is adapted to substantially block the path of any dunnage pieces 20 that are located above the first gate member and within the magazine. By contrast, the gripper gate, which is exemplified by the second gate member 137, is adapted to substantially laterally impinge upon, or grip, a given dunnage piece 20 to thereby substantially immobilize the given dunnage piece. As is evident from further study of FIG. 4, the second gate member 137 can have a substantially pointed or sharp profile that is adapted to facilitate gripping and/or immobilization of the dunnage piece 20 against which the second gate member impinges.

With reference now to both FIGS. 3 and 4, a description of a general operational sequence of the magazine 130 according to the exemplary embodiment of the present disclosure follows. Initially, the magazine 130 is empty, with the first gate 136 and the second gate 137 being in respective open positions (as depicted in FIG. 3). In preparation for loading dunnage pieces 20 into the magazine 130, the first gate 136 is moved to a closed position (as depicted in FIG. 4) to substantially block the lower end 136, while the second gate 137 remains open. Dunnage pieces 20 are introduced or loaded into the magazine 130 through the upper end 139. The dunnage pieces 20 can be introduced into the magazine 130 by one of a number of means. According to the exemplary embodiment of the present disclosure, the dunnage pieces 20 are loaded into the upper end 139 of the magazine 130 by the dunnage feed conveyor 140 (shown in FIG. 2).

The magazine 130 can be configured in one of a number of specific dunnage capacities. A study of FIG. 4 reveals that the exemplary dunnage magazine 130 is configured to have a capacity of five (5) dunnage pieces 20. According to the exemplary embodiment of the present disclosure, the process of loading dunnage pieces 20 into the magazine 130 is temporarily stopped in response to detecting that the magazine 130 contains a predetermined number dunnage pieces. This predetermined number of dunnage pieces 20 can be, for example, a number of dunnage pieces equal to the capacity of the magazine 130, which according to the exemplary embodiment of the present disclosure, is five (5) dunnage pieces. The process of loading dunnage pieces 20 into the magazine can be started in response to detecting that the number of dunnage pieces within the magazine 130 has fallen to a predetermined number which is less than the maximum capacity of the magazine. In response to a detecting that a predetermined number of dunnage pieces 20 have been loaded into the magazine 130, the second gate member 137 is moved from an open position (as shown in FIG. 3) to a closed position (as shown in FIG. 4). By way of example only, the second gate member 137 is closed in response to detecting that five (5) dunnage pieces have been loaded into the magazine 130.

Continued study of FIG. 4 reveals that the first gate member 136, when it is in the closed position, is adapted to at least partially support the dunnage pieces 20 that are in the magazine 130. As is seen, the specific configuration of the magazine 130 causes all of the dunnage pieces 20 within the magazine to be arranged in a "single file" orientation. The first gate member 136, when in the closed position, is in contact with the lowest of the dunnage pieces 20 within the magazine 130. The second gate member 137, when in the closed position, is in contact with the second lowest of the dunnage piece 20 within the magazine 130. The second lowest of the dunnage pieces within the magazine 130 is immediately above the lowest of the dunnage pieces. The remainder of the dunnage pieces 20 are located substantially above the second lowest of the dunnage pieces.

As is explained in greater detail hereinbelow with respect to additional drawing figures, the dunnage pieces 20 within the magazine 130 can be selectively released therefrom. According to the exemplary embodiment of the present disclosure, the dunnage pieces 20 can be selectively released from the magazine 130 one-at-a-time. With reference to both FIGS. 3 and 4, the lowermost of the dunnage pieces within the magazine 130 is selectively released therefrom by moving the first gate member 136 from the closed position (as shown in FIG. 4) to the open position (as shown in FIG. 3), while the second gate member 137 remains in the closed position (as shown in FIG. 4). This allows the lowermost of the dunnage pieces 20 within the magazine 130 to fall therefrom under the force of gravity through the lower end 135, while the remainder of the dunnage pieces within the magazine are retained therein at least in part by action of the second gate member 137 as it remains closed.

After the lowermost of the dunnage pieces 20 within the magazine 130 is completely released therefrom, the first gate member 136 is moved from the open position to the closed position, while the second gate member 137 remains closed. After the first gate member 136 is fully closed, the second gate member 137 is opened to thereby allow the remaining dunnage pieces 20 to move downward under the force of gravity so that the lowermost of the dunnage pieces comes into contact with the first gate member 136. After the lowermost of the dunnage pieces 20 comes into contact with the first gate member 136, the second gate member 137 is moved to the closed position. The aforementioned process can be repeated as necessary to selectively release each dunnage piece 20 from the magazine 130. Additional dunnage pieces 20 can be loaded into the magazine 130 through the upper end 139 in response to releasing a given number of dunnage pieces through the lower end 135, according to at least one embodiment of the present disclosure.

Figure 5:
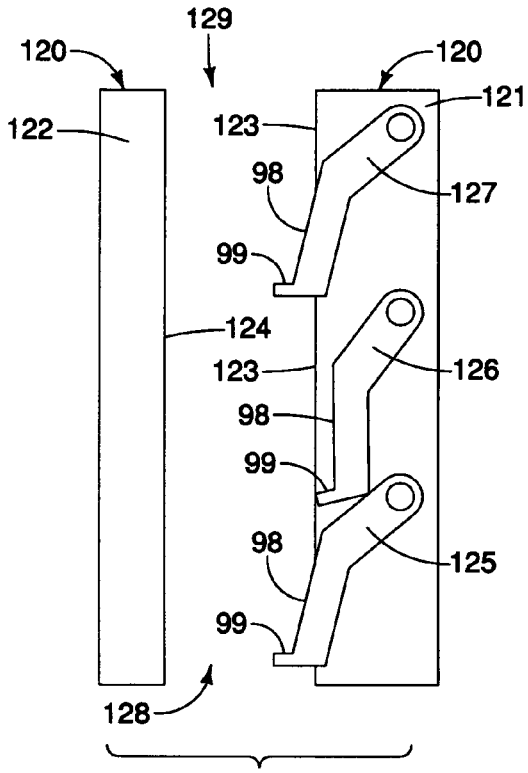
FIG. 5 is a simplified side elevation view in which a carriage of the apparatus of FIG. 2 is depicted in isolation.

Turning now to FIG. 5, a side elevation view depicts a carriage 120 in isolation according to one or more embodiments of the present disclosure. For illustrative purposes and/or for clarity, the depiction in FIG. 5 of the carriage 120 is simplified. Moreover, one or more components and/or portions of components of the carriage 120, which are not necessary for understanding the configuration and/or operational characteristics of the carriage, have been omitted. The carriage 120 includes at least two guides or guide sets. More specifically, the carriage includes at least one first guide 121 and at least one second guide 122. Each first guide 121 defines thereon a first guide surface 123. Similarly, each second guide 122 defines thereon a second guide surface 124. According to the exemplary embodiment of the present disclosure, the carriage 120 includes a plurality of first guides 121 and a plurality of second guides 122. The first guides 121 of the exemplary carriage 120 are arranged in mutually juxtaposed alignment, wherein only one first guide is visible in the view depicted by FIG. 5. Similarly, the second guides 122 of the exemplary carriage 120 are in mutually juxtaposed alignment, wherein only one second guide is visible in the view depicted by FIG. 5.

With continued reference to FIG. 5, each of the guides 121, 122 can be formed form a suitably durable material such as, for example, steel plate. According to the exemplary embodiment of the present disclosure, at least one first guide 121 is associated with at least one second guide 122. More specifically, the associated first guide 121 and second guide 122 are positioned relative to each other, wherein the first guide surface 123 and the associated second guide surface 124 are opposed or spaced apart in order to at least partially define therebetween a plurality of dunnage positions, which are described hereinbelow. The guides 121, 122 are tied together in substantially fixed relation to each other by being affixed to one or more braces, frameworks or other such structures, which are omitted for clarity.

The carriage 120 defines a lower end or opening 128 and an opposite upper end or opening 129. More specifically, the carriage lower end 128 can be described as the carriage exit, while the carriage upper end 129 can be described as the carriage entrance. A study of FIG. 5 reveals that each of the guide surfaces 123, 124 of the exemplary carriage 120 are substantially vertical. The carriage 120 is configured so that dunnage pieces (not shown) are introduced or loaded into the carriage through the upper end 129, and are released from the carriage through the lower end 128.

The carriage 120 includes at least one gate, or gate member. According to the exemplary embodiment of the present disclosure, the carriage 120 includes at least one of each of a lower gate or gate member 125, an intermediate gate or gate member 126, and an upper gate or gate member 127. The gate members 125, 126, 127 are operatively supported by the carriage 120. According to at least one embodiment of the present disclosure, one or more of the gates 125, 126, 127 is operatively supported, respectively, on one or more of the guides 121, 122. According to the exemplary embodiment, the gate members 125, 126, 127 are pivotally supported on the first guide 121, as shown. It is to be understood, however, that other configurations of the gate members 125, 126, 127 are contemplated according to alternative embodiments of the present disclosure. By way of example only, one or more of the gate members 125, 126, 127 can have the form of sliding gates rather than pivoting gates. Each of the gate members 125, 126, 127 is adapted to alternately substantially support and selectively release, a respective dunnage piece (not shown), as is described in greater detail with respect to additional drawing figures hereinbelow.

With continued reference to FIG. 5, each of the gates 125, 126, 127 is selectively moveable between respective open positions and closed positions. For purposes of illustrating these open and closed positions, the lower gate 125 and the upper gate 127 are each depicted in respective closed positions, while the intermediate gate 126 is depicted in an open position. According to the exemplary embodiment of the disclosure, each of the gates 125, 126, 127 is movable between their respective closed positions and open positions by way of a pivoting movement of the gate member relative to the respective first guide member 121, on which the gate members are supported. Such pivoting movement of the gates 125, 126, 127 is facilitated by one or more associated actuators (not shown) adapted to cause selective movement of respective gates according to one or more embodiments of the present disclosure.

Still referring to FIG. 5, each of the exemplary gate members 125, 126, 127 has a primary surface 98 and a secondary surface 99 defined thereon. The primary surface 98 is substantially straight and elongate. The secondary surface 99 is substantially straight and extends obliquely from the primary surface 98. A study of FIG. 5 reveals that when a given gate 125, 126, 127 is in the respective closed position, the primary surface 98 of the given gate will extend downwardly and toward the second guide surface 124 from the first guide surface 123. It is also evident that the secondary surface 99 will have a substantially normal orientation relative to the first and second guide surfaces 123, 124 when the given gate 125, 126, 127 is in the closed position. By contrast, no substantial portion of a given gate 125, 126, 127 will extend past the first guide surface 123 toward the second guide surface 124 when the gate is in the closed position, as is evident from a study of FIG. 5.

With continued reference to FIG. 5, the carriage 120 can include one or more sensors (not shown). At least one sensor is adapted to detect the presence of one or more dunnage pieces (not shown) within the carriage 120. According to at least one embodiment of the present disclosure, at least one is adapted to detect presence of a dunnage piece (not shown) at a given location or position within the carriage 120. By way of example only, one or more sensors can be at least one of a proximity sensor, a photoelectric sensor, and a limit switch. The sensors can be supported by the carriage 120. By way of example only, one or more sensors can be supported on one or more of the guides 121, 122. It is to be understood however, that the sensors associated with the carriage 120 can be supported on components and/or structure other than the carriage itself, according to one or more alternative embodiments of the present disclosure.

Figure 6:
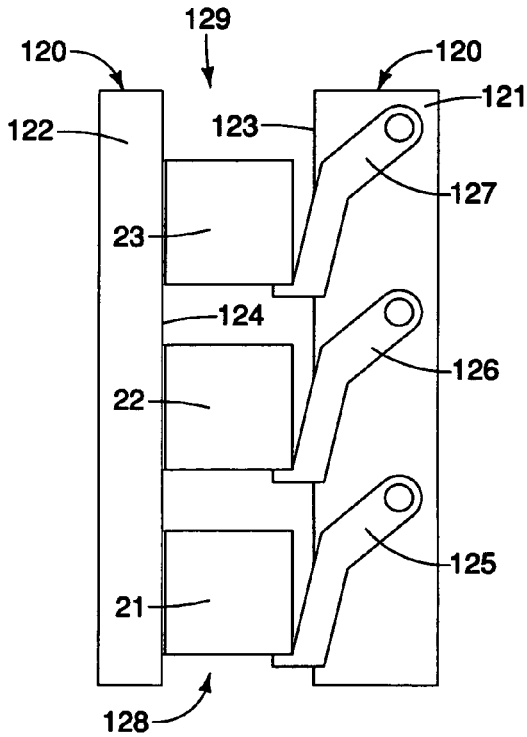
FIG. 6 is another simplified side elevation view of the carriage depicted in FIG. 5.

Turning now to FIG. 6, another side elevation view depicts the carriage 120, which is depicted in FIG. 5. The respective views of the carriage 120 in FIGS. 5 and 6 are substantially the same, except that FIG. 6 depicts all of the gate members 125, 126, 127 in respective closed positions, while FIG. 5 depicts the lower gate member 125 and the upper gate member 127 in respective closed positions, while depicting the intermediate gate member 126 in an open position. An additional difference between FIGS. 5 and 6 is that FIG. 6 depicts the carriage 120 in a loaded state, compared with FIG. 5 which depicts the carriage in an empty state. With reference to FIG. 6, a first dunnage piece 21, a second dunnage piece 22, and a third dunnage piece 23 are shown to be supported by the carriage 120.

The first, second, and third dunnage pieces 21, 22, 23 are the same as the dunnage pieces 20 (shown in FIGS. 1 and 2) described herein. However, the first, second, and third dunnage pieces 21, 22, 23 are described as such in order to facilitate understanding of operational aspects of the exemplary carriage 120. With reference to FIG. 6, the first dunnage piece 21 is depicted in a lower dunnage position, in which the first dunnage piece is at least partially retained by the lower gate 125. The second dunnage piece 22 is depicted in an intermediate dunnage position, in which the second dunnage piece is at least partially retained by the intermediate gate 126. Similarly, the third dunnage pieces 23 is depicted in an upper dunnage position, in which the third dunnage piece is at least partially retained by the upper gate 127. It is to be understood that, during the process of loading the carriage 120 and during the process of placing dunnage pieces, each of the first, second, and third dunnage pieces 21, 22, 23 will occupy each of the upper, the intermediate, and the lower dunnage positions at various times during those processes.

With reference now to FIGS. 3-6, a description is provided of a general operational sequence of releasing dunnage pieces from the magazine 130 and receiving the dunnage pieces into the carriage 120, and stowing the dunnage pieces on the carriage. Initially, the carriage 120 is empty, with no dunnage pieces supported by the carriage, and with the gates 125, 126, 127 closed. During the process of loading the carriage 120, the carriage is positioned below the magazine 130 (shown in FIGS. 3 and 4). More specifically, during the process of loading the carriage 120 (shown in FIGS. 5 and 6), the carriage is positioned (shown in FIGS. 3 and 4) so that the carriage entrance 129 is below and in substantial alignment with the magazine exit 135. This is because dunnage pieces 20, 21, 22, 23 are released, one-at-a-time, under the force of gravity from the magazine 130 through the magazine exit 135, whereupon the dunnage pieces are received into the carriage 120 by way of the carriage entrance 129.

During the carriage loading process, the magazine 130 can be operated in the manner generally described hereinabove with respect to FIGS. 3 and 4, wherein dunnage pieces are released from the magazine one-at-a-time, and are allowed to drop under the force of gravity through the magazine exit 135. With reference to FIGS. 3-6, the exemplary carriage loading process begins when the first dunnage piece 21 is released from the magazine 130 and is allowed to drop under the force of gravity through the magazine exit 135 and into the carriage 120 through the carriage entrance 129. The first dunnage piece 21 then comes to rest in the upper dunnage position where it is supported, at least partially, by the upper gate 127, which is in the closed position. The upper gate 127 then opens to allow the first dunnage piece 21 to drop under the force of gravity into the intermediate dunnage position where it is supported, at least partially, by the intermediate gate 126. After the first dunnage piece 21 is released from the upper dunnage position, the upper gate 127 moves back to the closed position.

In response to the upper gate 127 attaining a closed position, the magazine 130 releases the second dunnage piece 22 through the magazine exit 135. From the magazine 130, the second dunnage piece 22 drops under to force of gravity through the carriage entrance 129, and comes to rest in the upper dunnage position in which it is at least partially supported by the upper gate 127, which is in the closed position. Meanwhile, in response to the first dunnage piece 21 coming to rest in the intermediate dunnage position, the intermediate gate 126 opens to allow the first dunnage piece 21 to drop under the force of gravity to the lower dunnage position in which it is at least partially supported by the lower gate 125. After the first dunnage piece 21 is released from the intermediate position, the intermediate gate 126 moves back to the closed position.

In response to the second dunnage piece 22 coming to rest in the upper dunnage position, the upper gate 127 opens to allow the second dunnage piece to drop under the force of gravity to the intermediate dunnage position in which it is at least partially supported by the intermediate gate 126. After the second dunnage piece 22 is released from the upper position, the upper gate 127 is moved back into the closed position. In response to the upper gate 127 attaining a closed position, the magazine 130 releases the third dunnage piece 23 through the magazine exit 135. From the magazine 130, the third dunnage piece 23 drops under to force of gravity through the carriage entrance 129, and comes to rest in the upper dunnage position in which it is at least partially supported by the upper gate 127, which is in the closed position. The carriage 120 is now in a loaded state as depicted in FIG. 6, wherein the first dunnage piece 21 is stowed in the lower dunnage position proximate the lower gate 125, and the second dunnage piece 22 is stowed in the intermediate dunnage position proximate the intermediate gate 126, and the third dunnage piece 23 is stowed in the upper dunnage position proximate the upper gate 127.

A description of an exemplary procedure for releasing dunnage pieces 21, 22, 23 from the carriage 120 now follows. Such dunnage releasing procedure can be employed during placement of the dunnage pieces onto a stack unit (shown in FIG. 1), for example. With reference to FIG. 6, the carriage 120 is moved into a first placement position. The procedure for moving the carriage 120 into one or more various dunnage placement positions is described hereinbelow with reference to additional drawing figures. Still referring to FIG. 6, the first dunnage piece 21 is released from the carriage 120 in response to the carriage attaining the placement position for the first dunnage piece. The first dunnage piece 21 is released from the carriage 120 by causing the lower gate 125 to move from the closed position to the open position. Movement of the lower gate member 125 to the open position will allow the first dunnage piece 21 to drop downward under the force of gravity so as to be released from the lower dunnage position. In response to complete release of the first dunnage piece 21 from the lower dunnage position, the lower gate 125 is closed.

In response to the lower gate 125 attaining the closed position, the intermediate gate 126 is caused to move to the open position. Moving the intermediate gate 126 to the open position allows the second dunnage piece 22 to drop downward under the force of gravity from the intermediate dunnage position. The second dunnage piece 22 drops from the intermediate dunnage position into the lower dunnage position proximate the lower gate 125, which is in the closed position. In response to the second dunnage piece 22 coming to rest in the lower dunnage position, the intermediate gate 126 is caused to move to the closed position. In response to the intermediate gate 126 attaining the closed position, the upper gate 127 is caused to move to the open position. Movement of the upper gate 127 to the open position allows the third dunnage piece 23 to drop downward under the force of gravity from the upper dunnage position. The third dunnage piece 23 drops from the upper dunnage position into the intermediate dunnage position proximate the intermediate gate 126, which is in the closed position. At this point in the dunnage release procedure, the first dunnage piece 21 has been released from the carriage 120, while the second dunnage piece 22 has moved from the intermediate dunnage position to the lower dunnage position proximate the lower gate 125, and the third dunnage piece 23 has moved from the upper dunnage position to the intermediate dunnage position proximate the intermediate gate 126.

In response to releasing the first dunnage piece 21 from the carriage 120, the carriage 120 is caused to move toward the placement position for the second dunnage piece 22. During movement of the carriage 120 to the placement position for the second dunnage piece 22, the second dunnage piece 22 and the third dunnage piece 23 can be dropped to the lower dunnage position and the intermediate dunnage position, respectively, as described hereinabove. In response to the arrival of the carriage 120 at the placement position for the second dunnage piece 22, the lower gate 125 is caused to move to the open position. Movement of the lower gate 125 to the open position allows the second dunnage piece 22 to drop downward from the lower dunnage position so as to be released from the carriage 120. In response to complete release of the second dunnage piece 22 from the carriage 120, the lower gate 125 is caused to move back to the closed position.

In response to the lower gate 125 attaining the closed position, the intermediate gate is caused to move to the open position. Movement of the intermediate gate 126 to the open position allows the third dunnage piece 23 to drop downward from the intermediate dunnage position to the lower dunnage position proximate the lower gate 125. In response to the third dunnage piece 23 arriving at the lower dunnage position, the intermediate gate 126 is moved back to the closed position. In response to release of the second dunnage piece 22 from the carriage 120, the carriage is caused to begin moving toward the placement position for the third dunnage piece. Repositioning of the third dunnage piece 23 from the intermediate position to the lower position can be performed during movement of the carriage 120 toward the placement position for the third dunnage piece.

In response to arrival of the carriage 120 at the placement position for the third dunnage piece 23, the lower gate 125 is caused to move to the open position. Movement of the lower gate 125 to the open position allows the third dunnage piece 23 to drop downward from the lower dunnage position so as to be released from the carriage 120. In response to complete release of the third dunnage piece 23 from the carriage 120, the lower gate 125 is caused to move back to the closed position. Also, in response to release of the third dunnage piece 23 from the carriage 120, the carriage is caused to move back toward the magazine 130 (shown in FIG. 2) to the loading position at which additional dunnage pieces are loaded into the carriage as described hereinabove.

Figure 7:
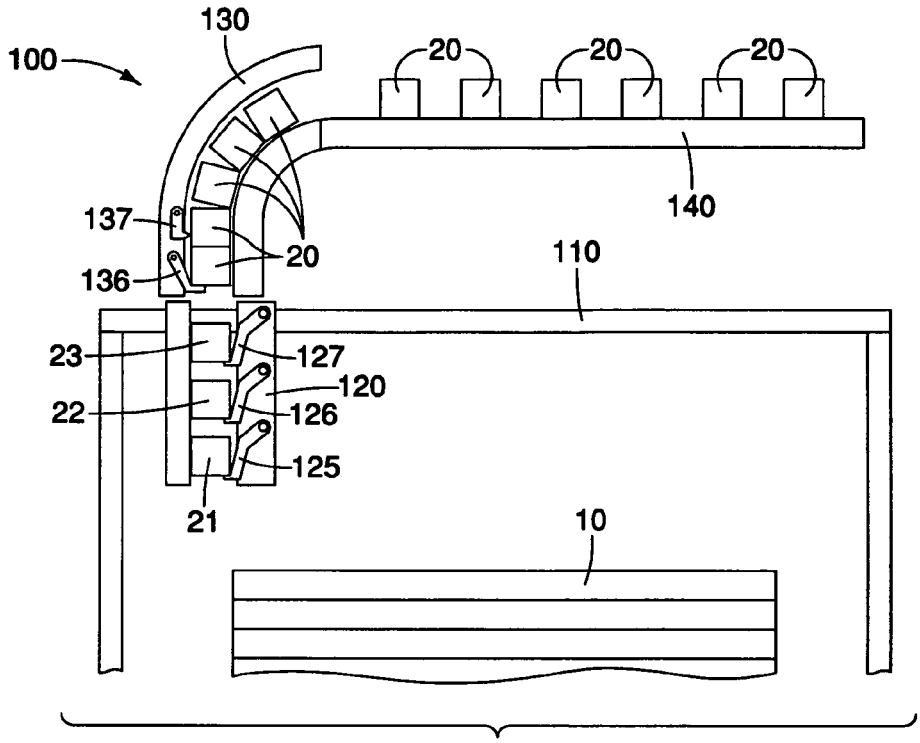
FIG. 7 is the first in a series of four simplified side elevation views in which operation of the carriage is depicted.
Figure 8:
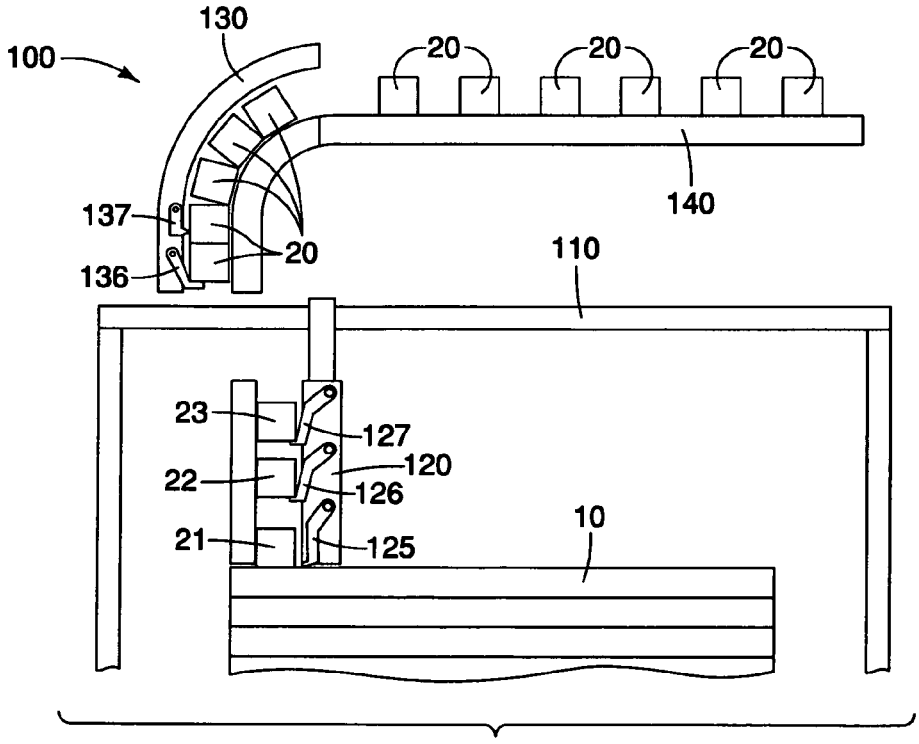
Figure 9:
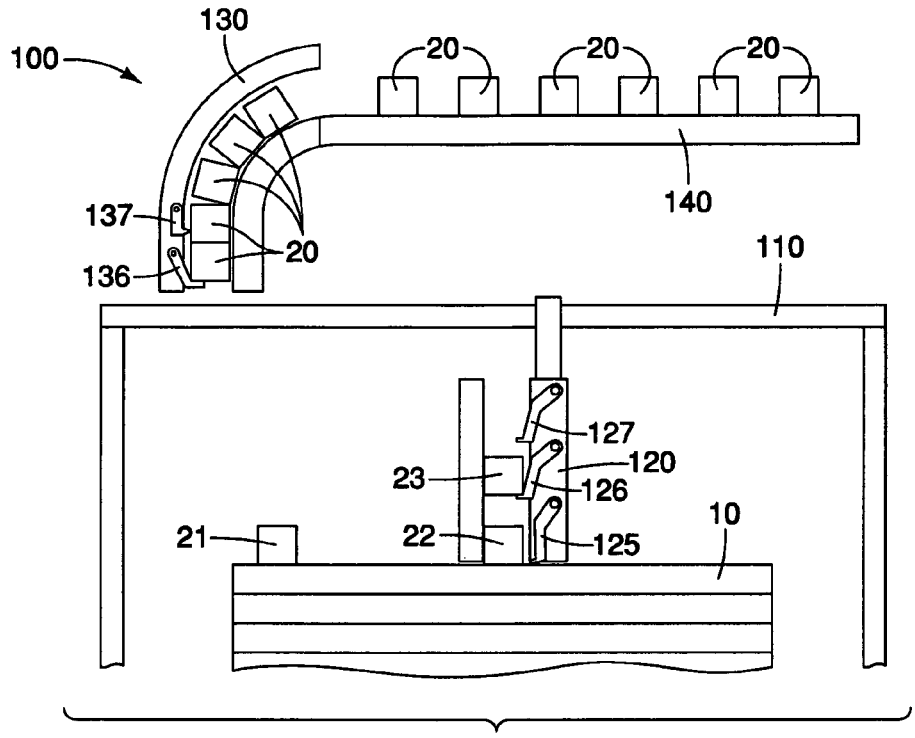
Figure 10:
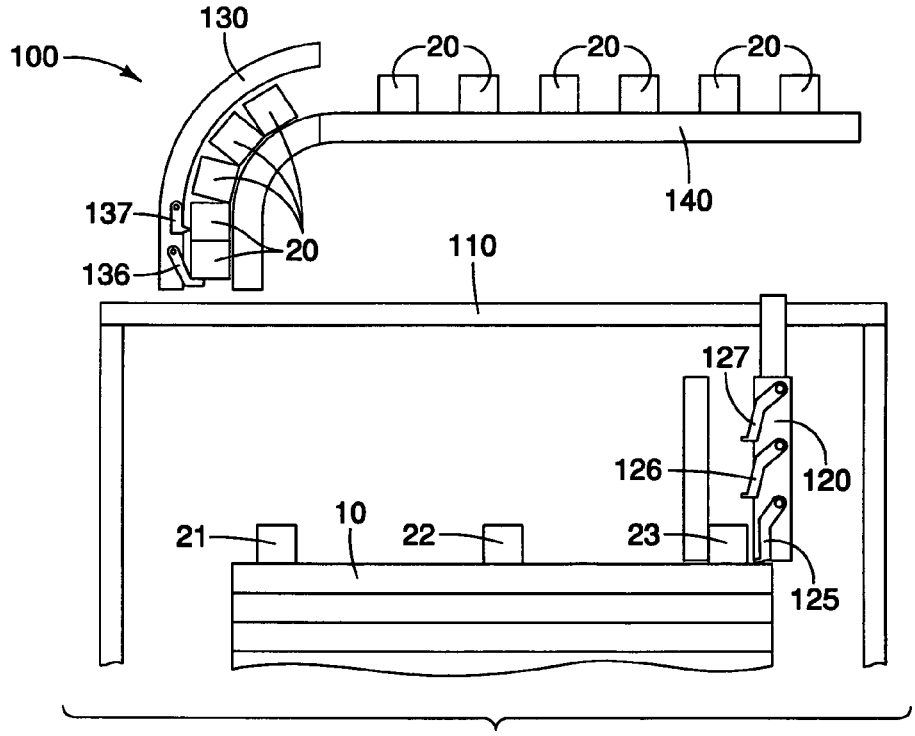

With reference now to FIGS. 7-10, a series of four side elevation views depicts the apparatus 100. The depiction of the apparatus 100 in FIGS. 7-10 is simplified and various components and/or portions of components have been omitted for clarity. All of the views of FIGS. 7-10 are substantially similar, except that the carriage 120 and each of the dunnage pieces 21, 22, 23 are shown in different respective positions in each of the four views. The series of views depicted by FIGS. 7-10 illustrates an operational sequence of the carriage as it places dunnage pieces on a stack unit 10. More specifically, the view of FIG. 7 depicts the carriage 120 in a loading position, while the view of FIG. 8 depicts the carriage in a first dunnage placing position. The view of FIG. 9 depicts the carriage 120 in a second dunnage placing position, while the view of FIG. 10 depicts the carriage in a third dunnage placing position.

With reference to FIG. 7, the carriage 120 is depicted in a dunnage loading position. As is seen from a study of FIG. 7, the carriage 120 is positioned below the magazine 130. The carriage 120 is also shown to be in substantial alignment with the magazine 130 to facilitate loading of dunnage pieces into the carriage from the magazine. As is depicted in FIG. 7, the carriage 120 is in a loaded state and contains a first dunnage piece 21 in the lower dunnage position proximate the lower gate 125. The carriage 120 also contains a second dunnage piece 22 in the intermediate dunnage position proximate the intermediate gate 126, and a third dunnage piece 23 in the upper dunnage position proximate the upper gate 127. The dunnage pieces 21, 22, 23 can be loaded into the carriage 120 from the magazine 130 as described hereinabove with reference to FIGS. 3-6. As is depicted in FIG. 7, a stack unit 10 is in the receiving position, and the carriage 120 is ready to begin a placing dunnage pieces onto the stack unit.

Turning now to FIG. 8, the carriage 120 is depicted in a first dunnage placing position. That is, the carriage 120 has moved, or to has been repositioned relative to the chassis 110, from the dunnage loading position (depicted in FIG. 7) to a first dunnage placement position (depicted in FIG. 8). According to the exemplary embodiment of the present disclosure, movement of the carriage 120 from the loading position to the first dunnage placement position includes an initial movement in a substantially horizontal direction followed by movement in a substantially vertical downward direction. As is evident from a study of FIG. 8, the carriage 120 has extended substantially vertically downward from the chassis 110. This vertical extension capability of the carriage is accomplished by way of one or more mechanical components such as, for example, tracks, guides, telescoping rails, followers, etc. (not shown).

The exemplary carriage 120 is caused to move relative to the chassis 110 both vertically and horizontally by way of one or more various devices including, but not limited to, actuators, motors, mechanical transmissions, and the like (not shown). The carriage 120 can reach the first dunnage placement position with the aid of one or more sensors (not shown) adapted to detect the position of the carriage relative to the stack unit 10. For example, according to the exemplary embodiment of the present disclosure, one or more sensors (not shown) are adapted to detect when the carriage 120 arrives at a predetermined vertical distance from the top of the stack unit 10. When this predetermined vertical distance is detected, the carriage 120 can be caused to stop at a given vertical distance from the top of the stack unit 10 that is associated with the first placement position. As is depicted in FIG. 8, the lower gate 125 has opened to release the first dunnage piece 21 from the lower dunnage position of the carriage 120, wherein the first dunnage piece has been placed onto the stack unit 10.

Turning now to FIG. 9, the carriage 120 is depicted in a second dunnage position. That is, in response to releasing the first dunnage piece 21, the carriage 120 has moved, or to has been repositioned, from the first dunnage placement position (depicted in FIG. 8) to a second dunnage placement position (depicted in FIG. 9). According to the exemplary embodiment of the present disclosure, movement of the carriage 120 from the first dunnage placement position to the second dunnage placement position includes an initial movement in a substantially vertically upward direction followed by movement in a substantially horizontal direction followed by movement in a substantially vertically downward direction. As is depicted in FIG. 9, the first dunnage piece 21 has remained at the position in which it was placed by the carriage 120 before the carriage moved to the second dunnage placement position.

It is to be understood that, during movement of the carriage 120 from the first dunnage placement position to the second dunnage placement position, the second dunnage piece 22 is repositioned from the intermediate dunnage position proximate the intermediate gate 126 to the lower dunnage position proximate the lower gate 125. Additionally, during this movement of the carriage 120, the third dunnage piece 23 is repositioned from the upper dunnage position proximate the upper gate 127 to the intermediate dunnage position proximate the intermediate gate 126. Further study of FIG. 9 reveals that the lower gate 125 has opened to release the second dunnage piece 22 from the lower dunnage position of the carriage 120, wherein the second dunnage piece has been placed onto the stack unit 10.

Turning now to FIG. 10, the carriage 120 is depicted in a third dunnage placement position. That is, in response to releasing the second dunnage piece 22, the carriage 120 has moved, or has been repositioned, from the second dunnage placement position (depicted in FIG. 9) to a third dunnage placement position (depicted in FIG. 10). According to the exemplary embodiment of the present disclosure, movement of the carriage 120 from the second dunnage placement position to the third dunnage placement position includes an initial movement in a substantially vertically upward direction followed by movement in a substantially horizontal direction followed by movement in a substantially vertically downward direction.

As is depicted in FIG. 10, the second dunnage piece 22 has remained at the position on the stack unit 10 in which it was placed by the carriage 120 before the carriage moved to the third dunnage placement position. It is to be understood that, during movement of the carriage 120 from the second dunnage placement position to the third dunnage placement position, the third dunnage piece 23 is repositioned from the intermediate dunnage position proximate the intermediate gate 126 to the lower dunnage position proximate the lower gate 125. Further study of FIG. 10 reveals that the lower gate 125 has opened to release the third dunnage piece 23 from the lower dunnage position of the carriage 120, wherein the third dunnage piece has been placed onto the stack unit 10.

With reference now to FIGS. 7 and 10, the carriage 120 is empty after releasing the third dunnage piece 23 at the third dunnage placement position. That is, as described hereinabove, the first, second, and third dunnage pieces 21, 22, 23 have been released from the carriage 120, and have been placed onto the stack unit 10, as depicted in FIG. 10. In response to releasing the third dunnage piece 23, the carriage 120 is caused to return, or move back, to the carriage loading position beneath the magazine 130, which position is depicted in FIG. 7. Also, in response to release of the third dunnage piece 23 from the carriage 120, the stack unit 10 is moved from beneath the chassis 110. More specifically, for example, the stack unit 10 can be moved to the stack unit removal position 33 as is described hereinabove, and which position is depicted in FIG. 2.

Upon arrival of the carriage 120 at the carriage loading position (depicted in FIG. 7), the carriage is again loaded with dunnage pieces 20 from the magazine 130 as is described hereinabove. While the carriage 120 is returning to the carriage loading position and/or while the carriage is receiving dunnage pieces 20 from the magazine 130, another stack unit 10, which is to have dunnage pieces placed upon it, is moved into the receiving position 32 (as is depicted in FIG. 2). The above-described procedure of causing the carriage 120 to move to the first, second, and third dunnage placing positions, to thereby place the first second and third dunnage pieces 21, 22, 23 onto the stack unit 10, can be repeated in response to detecting that the carriage 120 is fully loaded with the first, second, and third dunnage pieces, and in response to detecting that the stack unit 10 is in the receiving position substantially beneath the chassis 10. The above-described procedure can be repeated as desired to place dunnage pieces 20, 21, 22, 23 onto respective stack units 10.

Figure 11:
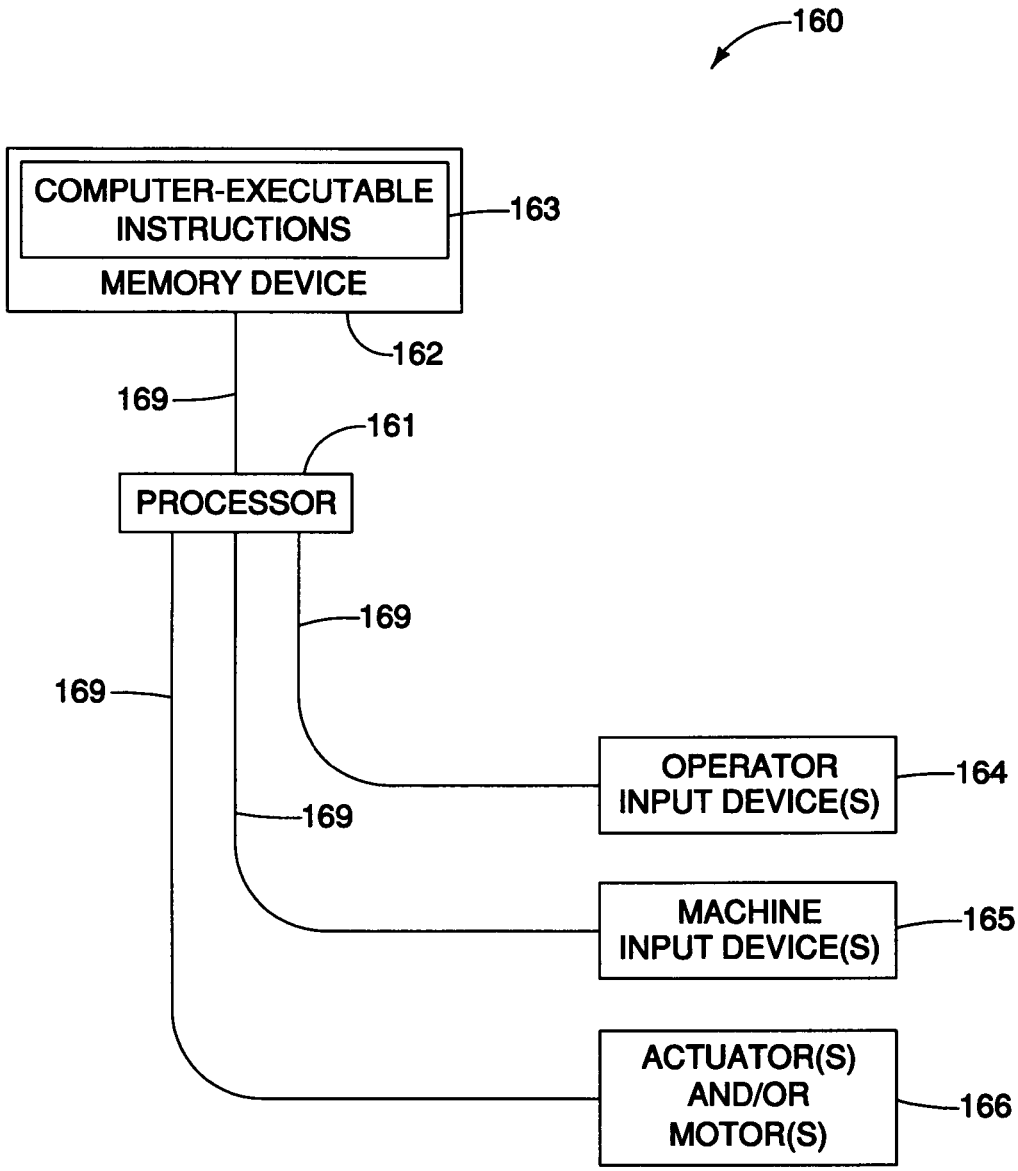
FIG. 11 is a schematic view in which is depicted the control system of the apparatus shown in FIG. 2.

Turning now to FIG. 11, a schematic view depicts the control system 160 in isolation, according to at least one embodiment of the present disclosure. The exemplary control system 160 includes a processor 161 and a memory device 162. The control system 160 includes a set of computer-executable instructions 163 that are stored on the memory device 162. The set of computer-executable instructions 163 can be in the form of a computer program, for example. The computer-executable instructions 163 are accessible by the processor 161, whereby the processor can execute the computer executable instructions to facilitate operation of the apparatus 100 (shown in FIG. 2). The computer executable instructions 163 can contain one or more algorithms in accordance with which one or more components of the apparatus 100 are operated or moved.

Still referring to FIG. 11, the control system 160 includes at least one operator input device 164. The operator input device 164 is adapted to facilitate input of control parameters from a human operator to the processor 161 and/or to the memory device 162 and/or to the computer-executable instructions 163. The operator input device 164 can have at least one of a number of configurations such as, for example, that of a keyboard or a touch screen. The control system 160 also includes at least one machine input device 165. The machine input device 165 is adapted to generate and/or collect one or more various types of data that is sent to the processor 161. The input device 165 can have at least one of a number of configurations such as, for example, that of a sensor, an encoder, or a counter.

The control system 160 includes at least one actuator and/or motor 166. The actuator and/or motor 166 is adapted to facilitate movement of one or more components of the apparatus 100 (shown in FIG. 2) through application of mechanical force and/or power to cause such movement. The actuator and/or motor 166 can include various components and/or subsystems required for operation, which can include, for example, relays, power supplies (e.g. electrical, pneumatic, hydraulic), mechanical linkages, and mechanical transmissions. The actuator and/or motor 166 can have at least one of a number of configurations such as, for example, linear motors, stepper motors, pneumatic cylinders, hydraulic cylinders, and solenoids. The actuator and/or motor 166 is an output device and is adapted to carry out commands generated by the processor 161. The commands can be in the form of output signals, for example.

With continued reference to FIG. 11, the control system 160 can include one or more data links 169. The data links 169 are adapted to transmit or carry data signals between two or more components of the control system 160. Each data link 169 is connected between two or more components of the control system 160 to facilitate transmission therebetween of one or more types of data in the form of data signals. The data transmitted and/or carried by the data links 169 can be in the form of output or control signals, and input signals, for example.

With reference now to FIGS. 2-11, the exemplary apparatus 100 includes a plurality of machine input devices 165 (shown in FIG. 11) that are positioned relative to one or more components of the apparatus to thereby facilitate substantial automatic operation of the apparatus. It is to be understood that the machine input devices 165 are shown schematically only in FIG. 11, and that the machine input devices have been omitted from other views in the interest of clarity. By way of example only, one or more machine input devices 165 that are in the form of sensors can be positioned to detect whether a predetermined number of dunnage pieces 20 are within the magazine 130. By way of further example, one or more machine input devices 165 that are in the form of sensors can be positioned to detect whether one or more dunnage pieces 20, 21, 22, 23 is in one or more dunnage positions within the carriage 120. More specifically, one or more machine input devices 165 that are in the form of sensors can be positioned to determine whether a respective dunnage piece 20, 21, 22, 23 is in each of the lower dunnage position proximate the lower gate 125, the intermediate dunnage position proximate the intermediate gate 126, and the upper position proximate the upper gate 127.

According to at the exemplary embodiment of the present disclosure, one or more machine input devices 165 can be positioned to determine the elevation and/or vertical position of the carriage relative to a stack unit 10 at the receiving position 32. At least one machine input device 165 can be positioned to determine a location or position of a stack unit 10 on the stack unit conveyor 150. By way of example, only, one or more matching input devices 165 can be positioned to determine whether a stack unit 10 is in the dunnage placement position 32, as depicted in FIG. 2. Each of the machine input devices 165 of the control system 160 is adapted to initiate generation of a data signal and transmission of that data signal to the processor 161. Such data signals from the machine input devices 165 contain data indicative of one or more operational parameters that are usable by the processor 169 in making operational decisions. It is to be understood that additional and/or alternative implementations of the input devices 165 are within the scope of respective alternative embodiments of the present disclosure.

With continued reference to FIGS. 2-11, the apparatus 100 includes a plurality of actuators and/or motors 166 (shown in FIG. 11) that are connected to one or more components of the apparatus to thereby facilitate substantial operation of the apparatus. It is to be understood that the actuators and/or motors 166 are shown schematically only in FIG. 11, and that the actuators and/or motors have been omitted from other views in the interest of clarity. By way of example only, one or more actuators and/or motors 166 can be adapted to cause selective movement and/or actuation and/or operation of one or more of: the carriage 120 relative to the chassis 110; the carriage gates 125, 126, 127 relative to the carriage; the magazine gates 136, 137 relative to the magazine; the magazine feed conveyor 140; and the stack conveyor 150. Each of the actuators and/or motors 166 are adapted to receive control signals initiated by the processor 161, and to cause movement of one or more associated components of the apparatus 100 in accordance with the control signals. It is to be understood that the control system 160 can include components and/or devices in addition to those that are specifically depicted and described herein. It is to be understood that additional and/or alternative implementations of the actuators and/or motors 166 are within the scope of respective alternative embodiments of the present disclosure.

According to at least one embodiment of the present disclosure, a method of placing dunnage pieces is provided. It is to be understood that the methods of placing dunnage pieces are commensurate with the description of the operation of the apparatus provided herein with reference to the drawing figures. For example, according to at least one embodiment of the present disclosure, a method of placing dunnage pieces includes providing an apparatus 100 that includes a chassis 110, a carriage 120, a dunnage magazine 130, and a control system 160. The carriage 120 is movably supported by the chassis 110 and is adapted to receive dunnage pieces 20, 21, 22, 23 from the magazine 130. The carriage 120 includes a lower gate 125, an intermediate gate 126 substantially above the lower gate, and an upper gate 127 substantially above the intermediate gate. The control system 160 is adapted to control operation of the apparatus 100, and includes a memory device 162 and a set of computer-executable instructions 163 stored on the memory device and adapted to cause the control system to operate the apparatus. The dunnage magazine 130 is adapted to contain therein a plurality of dunnage pieces 20, 21, 22, 23, and is further adapted to selectively release the contained dunnage pieces.

The method includes causing the magazine 130 to release a first dunnage piece 21 into an upper dunnage position in the carriage 120 proximate the upper gate 127, and causing the upper gate 127 to open to release the first dunnage piece 21 from the upper dunnage position into an intermediate dunnage position in the carriage 120 proximate the intermediate gate 126. The method includes causing the intermediate gate 126 to open to release the first dunnage piece 21 from the intermediate dunnage position into a lower dunnage position in the carriage 120 proximate the lower gate 125, and causing the magazine 130 to release a second dunnage piece 22 into the upper dunnage position proximate the upper gate 127.

The method further includes causing the upper gate 127 to open to release the second dunnage piece 22 from the upper dunnage position into the intermediate dunnage position proximate the intermediate gate 126, and causing the magazine 130 to release a third dunnage piece 23 into the upper dunnage position proximate the upper gate 127. The method includes causing the lower gate 125 to open to release the first dunnage piece 21 from the lower dunnage position, thereby placing the first dunnage piece. The method can includes placing the first dunnage piece 21 onto a stack unit 10.

The method also includes causing the intermediate gate 126 to open to release the second dunnage piece 22 from the intermediate dunnage position into the lower dunnage position proximate the lower gate 125, and causing the upper gate 127 to open to release the third dunnage piece 23 from the upper dunnage position into the intermediate dunnage position proximate the intermediate gate 126. The method further includes causing the lower gate 125 to open to release the second dunnage piece 22 from the lower dunnage position, thereby placing the second dunnage piece. The method can include placing the second dunnage piece 22 onto the stack unit 10.

The method includes causing the intermediate gate 126 to open to release the third dunnage piece 23 from the intermediate dunnage position into the lower dunnage position proximate the lower gate 125, and causing the lower gate 125 to open to release the third dunnage piece 23 from the lower dunnage position, thereby placing the third dunnage piece. The method can include placing the third dunnage piece 23 onto the stack unit 10.

What is claimed is:

1. A dunnage placing apparatus, comprising:

a chassis;

a dunnage magazine adapted to contain therein a plurality of dunnage pieces, and further adapted to selectively release the contained dunnage pieces;

a carriage movably supported by the chassis and adapted to receive dunnage pieces from the magazine, wherein the carriage comprises a lower gate, an intermediate gate substantially above the lower gate, and an upper gate substantially above the intermediate gate; and a control system adapted to control operation of the apparatus, wherein the control system comprises a memory device; and a set of computer-executable instructions stored on the memory device and adapted to cause the control system to operate the apparatus in a manner wherein:

the magazine releases a first dunnage piece into an upper dunnage position in the carriage proximate the upper gate;

the upper gate opens to release the first dunnage piece from the upper dunnage position into an intermediate dunnage position in the carriage proximate the intermediate gate;

the intermediate gate opens to release the first dunnage piece from the intermediate dunnage position into a lower dunnage position in the carriage proximate the lower gate;

the magazine releases a second dunnage piece into the upper dunnage position proximate the upper gate;

the upper gate opens to release the second dunnage piece from the upper dunnage position into the intermediate dunnage position proximate the intermediate gate;

the magazine releases a third dunnage piece into the upper dunnage position proximate the upper gate;

the lower gate opens to release the first dunnage piece from the lower dunnage position, thereby placing the first dunnage piece;

the intermediate gate opens to release the second dunnage piece from the intermediate dunnage position into the lower dunnage position proximate the lower gate;

the upper gate opens to release the third dunnage piece from the upper dunnage position into the intermediate dunnage position proximate the intermediate gate;

the lower gate opens to release the second dunnage piece from the lower dunnage position, thereby placing the second dunnage piece;

the intermediate gate opens to release the third dunnage piece from the intermediate dunnage position into the lower dunnage position proximate the lower gate; and the lower gate opens to release the third dunnage piece from the lower dunnage position, thereby placing the third dunnage piece.

2. The dunnage placing apparatus according to claim 1, wherein:

the carriage is selectively movable relative to the chassis between: a loading position, at which the first dunnage piece, the second dunnage piece and the third dunnage piece are released by the magazine and received by the carriage into the first dunnage position, the second dunnage position, and the third dunnage position, respectively; a first placing position at which the first dunnage piece is released from the lower dunnage position of the carriage; a second placing position, at which the second dunnage piece is released from the lower dunnage position of the carriage; and a third placing position, at which the third dunnage piece is released from the lower dunnage position of the carriage; and the set of computer-executable instructions is further adapted to cause the control system to operate the apparatus in a manner whereby:

the carriage is repositioned from the loading position to the first placing position at which the first dunnage piece is placed;

the carriage is repositioned from the first placing position to the second placing position at which the second dunnage piece is placed;

the carriage is repositioned from the second placing position to the third placing position at which the third dunnage piece is placed; and the carriage is repositioned from the third placing position to the loading position.

3. The dunnage placing apparatus according to claim 1, wherein:

the carriage is adapted to place dunnage pieces onto a stack unit having a first end and an opposite second end;

the carriage is selectively movable relative to the chassis between: a loading position, at which the first dunnage piece, the second dunnage piece and the third dunnage piece are released by the magazine and received by the carriage into the first dunnage position, the second dunnage position, and the third dunnage position, respectively; a first placing position at which the first dunnage piece is released from the lower dunnage position of the carriage; a second placing position, at which the second dunnage piece is released from the lower dunnage position of the carriage; and a third placing position, at which the third dunnage piece is released from the lower dunnage position of the carriage; and the set of computer-executable instructions is further adapted to cause the control system to operate the apparatus in a manner whereby:

the carriage is repositioned from the loading position to the first placing position at which the first dunnage piece is placed onto the stack unit proximate the first end;

the carriage is repositioned from the first placing position to the second placing position at which the second dunnage piece is placed onto the stack unit between the first end and the second end;

the carriage is repositioned from the second placing position to the third placing position at which the third dunnage piece is placed onto the stack proximate the second end; and the carriage is repositioned from the third placing position to the loading position.

4. The dunnage placing apparatus according to claim 1, further comprising a stack conveyor adapted to convey thereon a stack unit:

from an initial position, at which the stack unit is placed on the stack conveyor, to a dunnage placing position at which the first dunnage piece, the second dunnage piece and the third dunnage piece are placed on the stack unit; and from the dunnage placing position to a removal position at which the stack unit is removed from the stack conveyor.

5. The dunnage placing apparatus according to claim 1, wherein the magazine comprises:

a plurality of guides that define thereon opposed guide surfaces between which a plurality of dunnage pieces are selectively contained, wherein the magazine is characterized by an upper end through which the dunnage pieces are introduced into the magazine, and an opposite lower end through which the dunnage pieces are released from the magazine under the force of gravity;

a gate proximate the lower end of the magazine and adapted to be selectively operable by the control system between a closed position, whereby the dunnage pieces contained within the magazine are prevented from being released therefrom, and an open position, whereby at least one dunnage piece is released from the magazine under the force of gravity.

6. The dunnage placing apparatus according to claim 1, wherein the carriage comprises a plurality of guides defining thereon spaced apart, substantially vertically oriented guide surfaces that define therebetween the lower dunnage position, the intermediate dunnage position, and the upper dunnage position.

7. The dunnage placing apparatus according to claim 1, wherein:

the carriage comprises a first guide having a first guide surface defined thereon, and a second guide having a second guide surface defined thereon; and each of the lower gate, the intermediate gate and the upper gate is substantially in the form of a respective arm pivotally supported by the first guide, and each of the lower gate, the intermediate gate and the upper gate is defined by a respective substantially straight primary surface and a respective substantially straight secondary surface, wherein when each of the lower gate, the intermediate gate and the upper gate is in the respective closed position, the respective primary surface extends from the first guide surface in a substantially downwardly sloped direction, while the respective secondary surface is oriented substantially normally relative to the first guide surface.

8. A method of placing dunnage pieces, comprising:

providing an apparatus that comprises a chassis; a dunnage magazine adapted to contain therein a plurality of dunnage pieces, and further adapted to selectively release the contained dunnage pieces; a carriage movably supported by the chassis and adapted to receive dunnage pieces from the magazine, wherein the carriage comprises a lower gate, an intermediate gate substantially above the lower gate, and an upper gate substantially above the intermediate gate; and a control system adapted to control operation of the apparatus, wherein the control system comprises a memory device; and a set of computer-executable instructions stored on the memory device and adapted to cause the control system to operate the apparatus;

causing the magazine to release a first dunnage piece into an upper dunnage position in the carriage proximate the upper gate;

causing the upper gate to open to release the first dunnage piece from the upper dunnage position into an intermediate dunnage position in the carriage proximate the intermediate gate;

causing the intermediate gate to open to release the first dunnage piece from the intermediate dunnage position into a lower dunnage position in the carriage proximate the lower gate;

causing the magazine to release a second dunnage piece into the upper dunnage position proximate the upper gate;

causing the upper gate to open to release the second dunnage piece from the upper dunnage position into the intermediate dunnage position proximate the intermediate gate;

causing the magazine to release a third dunnage piece into the upper dunnage position proximate the upper gate;

causing the lower gate to open to release the first dunnage piece from the lower dunnage position, thereby placing the first dunnage piece;

causing the intermediate gate to open to release the second dunnage piece from the intermediate dunnage position into the lower dunnage position proximate the lower gate;

causing the upper gate to open to release the third dunnage piece from the upper dunnage position into the intermediate dunnage position proximate the intermediate gate;

causing the lower gate to open to release the second dunnage piece from the lower dunnage position, thereby placing the second dunnage piece;

causing the intermediate gate to open to release the third dunnage piece from the intermediate dunnage position into the lower dunnage position proximate the lower gate; and causing the lower gate to open to release the third dunnage piece from the lower dunnage position, thereby placing the third dunnage piece.

* * * * *